US006150905A

United States Patent [19]

Nishijima

[11] Patent Number: 6,150,905

[45] Date of Patent: Nov. 21, 2000

[54] DIELECTRIC FILTER WITH THROUGH-HOLE HAVING LARGE AND SMALL DIAMETER PORTIONS AND A COUPLING ADJUSTMENT PORTION

[75] Inventor: Shohachi Nishijima, Komatsu, Japan

[73] Assignee: Murata Manufacturing Co., Ltd., Japan

[21] Appl. No.: 09/174,915

[22] Filed: Oct. 19, 1998

[30] Foreign Application Priority Data

Oct. 23, 1997 [JP] Japan ..... 9-290911

[51] Int. Cl.[7] ..... H01P 1/202; H01P 7/04

[52] U.S. Cl. ..... 333/206; 333/207; 333/222

[58] Field of Search ..... 333/203, 206, 333/207, 222

[56] References Cited

U.S. PATENT DOCUMENTS

| | | | |
|---|---|---|---|
| 4,506,241 | 3/1985 | Makimoto et al. | 333/222 |
| 4,733,208 | 3/1988 | Ishikawa et al. | 333/206 X |
| 5,124,676 | 6/1992 | Ueno | 333/206 |
| 5,436,602 | 7/1995 | McVeety et al. | 333/206 |
| 5,512,866 | 4/1996 | Vangala et al. | 333/134 |
| 5,517,163 | 5/1996 | Sagawa et al. | 333/206 X |
| 5,764,118 | 6/1998 | Saito et al. | 333/206 |
| 5,867,076 | 2/1999 | Tada et al. | 333/206 |
| 5,945,896 | 8/1999 | Miyamoto | 333/206 |

FOREIGN PATENT DOCUMENTS 10-335906 12/1998 Japan .

*Primary Examiner*—Benny Lee
*Assistant Examiner*—Barbara Summons
*Attorney, Agent, or Firm*—Ostrolenk, Faber, Gerb & Soffen, LLP

[57] ABSTRACT

On the internal surface of each of the through-holes formed in a dielectric block, an internal conductor is formed, while on the external surface except the top surface, an external conductor is formed. The internal conductors, together with the external conductor and the dielectric block, form dielectric resonators with ¼-wavelength using the top and bottom surfaces of the dielectric block as an open surface and a short surface, respectively. Each of the through-holes has a large-diameter hole portion and a small-diameter hole portion and also has a coupling adjustment hole portion for the purpose of a fine adjustment of electromagnetic coupling between adjacent the dielectric resonators.

17 Claims, 6 Drawing Sheets

DIELECTRIC FILTER WITH THROUGH-HOLE HAVING LARGE AND SMALL DIAMETER PORTIONS AND A COUPLING ADJUSTMENT PORTION

BACKGROUND OF THE INVENTION

1. Field of the Invention

The present invention relates to a dielectric filter, and more particularly to a dielectric filter having a plurality of dielectric resonators on a single dielectric block.

2. Description of the Related Art

A previously known dielectric filter of this kind is shown, for example, in FIG. 9. In FIG. 9, a dielectric filter 1 has a plurality of through-holes 3 which cut through a rectangular box-shaped dielectric block 2 from the top surface to the bottom surface viewed from FIG. 9. On the internal surfaces of the through-holes 3, internal conductors 4 are formed respectively. An external conductor 5 is formed on the external surface of the dielectric block 2 except for the top surface. The through-holes 3, together with the external conductor 5 and the dielectric block 2, form dielectric resonators 6, respectively, with ¼-wavelength, using the top and bottom surfaces of the dielectric block 2 as an open surface and a short surface respectively. The dielectric resonators 6 are electromagnetically coupled with each other to form a band-pass type filter.

On the top surface of the dielectric block 2, a pattern electrode 7 is formed to obtain a coupling capacitance Ck between the dielectric resonators 6 adjoining each other and to also adjust a stray capacitance Cs. Each of the pattern electrodes 7 is electrically coupled to one of the internal conductors 4, and the pattern electrodes 7 adjoining each other are separated across a gap g1 formed therebetween. On both ends of the top of the dielectric block 2, an input-pattern electrode 8 and an output-pattern electrode 9 are formed which are separated from the pattern electrodes 7 located at both ends across a gap g2 and a gap g3, respectively.

A dielectric filter is usually widely used for a filter of microwave band telecommunication equipment, and these apparatuses are being miniaturized each year. However, in a conventional dielectric filter, as shown in FIG. 9, with the size of the dielectric block 2 being reduced by miniaturization, an area of the pattern electrode 7 and a gap g1 between the pattern electrodes 7 adjoining each other are also reduced. Accordingly, when the pattern electrode 7 is printed in a process of manufacturing the dielectric filter 1, there has been a problem that bleeding associated with printing affects the coupling capacitance Ck and the stray capacitance Cs so as to greatly change them, causing fluctuation in characteristics of the dielectric filter 1.

In order to solve this problem, a dielectric filter 1' is suggested in which a through-hole 3 has a large-diameter hole portion 3*a* and a small-diameter hole portion 3*b*, which communicates with the large-diameter hole portion 3*a*, as shown in FIGS. 10 and 11, instead of the pattern electrode 7 disposed on the top surface of the dielectric block 2 as in the dielectric filter 1 shown in FIG. 9 (for example, see the translated PCT international publication No.8-512187). In the dielectric filter 1', since a pattern electrode is not required to be formed on the dielectric block 2, there is a solution of the problem involving the dielectric filter 1 shown in FIG. 9, that is, fluctuations in the coupling capacitance and the like due to the bleeding associated with the printing. This results in facilitating the miniaturization of the dielectric filter.

In the dielectric filter 1', the coupling capacitance Ck and the stray capacitance Cs of the dielectric resonators 6 which are disposed adjacent to each other can be adjusted by changing the diameter of the large-diameter hole portion 3*a* of each through-hole 3. However, when the length L1 in the axial direction of the large-diameter hole portion 3*a* is large, the amount of the change in the coupling capacitance corresponding to changes in the diameter of the large-diameter hole portion 3*a* is extremely large. Therefore, fine-adjustment of the coupling capacitance Ck is difficult which causes a problem of a wide range of variation of the coupling capacitance Ck.

Although in the dielectric filter 1', the axial length of the through-hole 3 can be shortened by changing the axial length L1 of the large-diameter hole portion 3*a* and the axial length L2 of the small-diameter hole portion 3*b*, it is also difficult to optimally adjust the shortening, the coupling capacitance Ck, and the stray capacitance Cs, simultaneously. This results in a problem of a small degree of freedom in the design.

SUMMARY OF THE INVENTION

Accordingly, it is an object of the present invention to provide a dielectric filter which can be readily miniaturized and has less variation in electromagnetic mutual coupling between dielectric resonators due to changes in the diameter of a larger-diameter hole portion, and further, which has a greater degree of freedom in the design.

Preferable embodiments according to the present invention provide a dielectric filter, comprising: a dielectric block having a first surface and a second surface being opposite to the first surface; a plurality of dielectric resonators having through-holes which pass through from the first surface to the second surface and internal conductors which cover the internal surfaces of the through-holes; and an external conductor which covers the external surface of the dielectric block except for the first surface, wherein at least one of the through-holes has a large-diameter hole portion and a small-diameter hole portion leading to the large-diameter hole portion, and wherein the dielectric filter further comprises a coupling adjustment hole portion for the purpose of a fine adjustment of electromagnetic coupling between adjacent the dielectric resonators, disposed at the side adjacent to the first surface of the dielectric block, having a different diameter from those of the large-diameter hole portion and the small-diameter hole portion, and leading to the large-diameter hole portion and the small-diameter hole portion.

In the above-mentioned dielectric filter, since at least one of the through-holes has the large-diameter hole portion and the small-diameter hole portion and also has the coupling adjustment hole portion for the purpose of a fine adjustment of electromagnetic coupling between adjacent dielectric resonators, the axial length of the through-hole 13 can be shortened to the most suitable length by adjusting the axial lengths of the large-diameter hole portion and the small-diameter hole portion. The electromagnetic coupling of the dielectric resonators adjoining each other can be roughly obtained by adjusting the diameters of the large-diameter hole portion and the small-diameter hole portion. Further, by adjusting the axial length and the diameter of the coupling adjustment hole portion and the like, a fine adjustment of the electromagnetic coupling of the dielectric resonators adjoining each other is achieved to obtain the most suitable electromagnetic coupling. Accordingly, a dielectric filter can be provided, which can be readily miniaturized and has less variation in electromagnetic mutual coupling between dielectric resonators due to changes in the diameter of a larger-diameter hole portion, and further which has a greater degree of freedom in the design.

Referring to the attached drawings, embodiments according to the present invention will be described.

DESCRIPTION OF THE PREFERRED EMBODIMENTS

Figure 1:
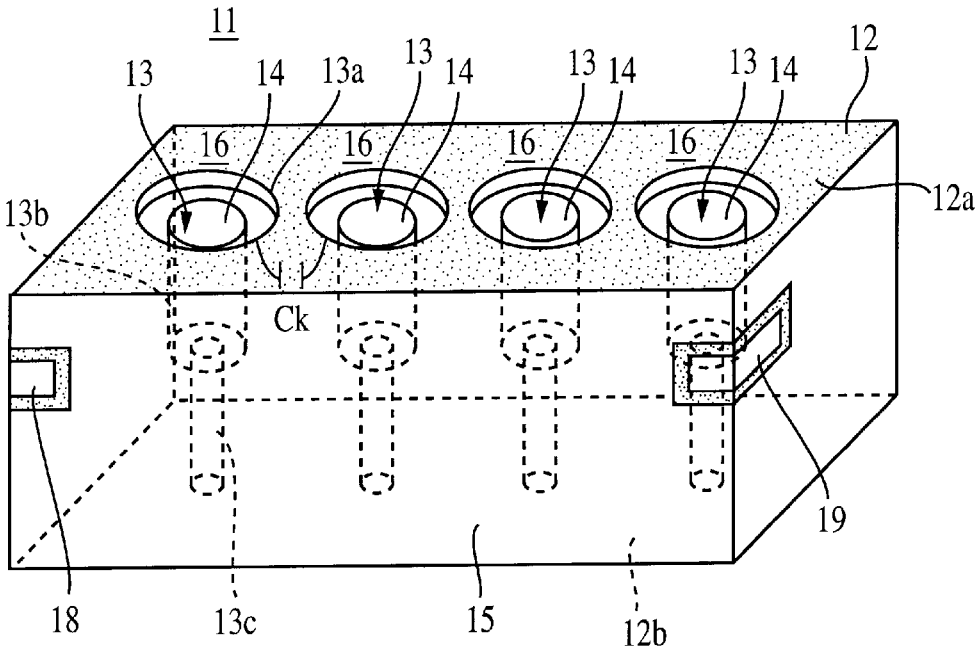
FIG. 1 is an external perspective view of a dielectric filter according to a preferable embodiment of the present invention.
Figure 2:
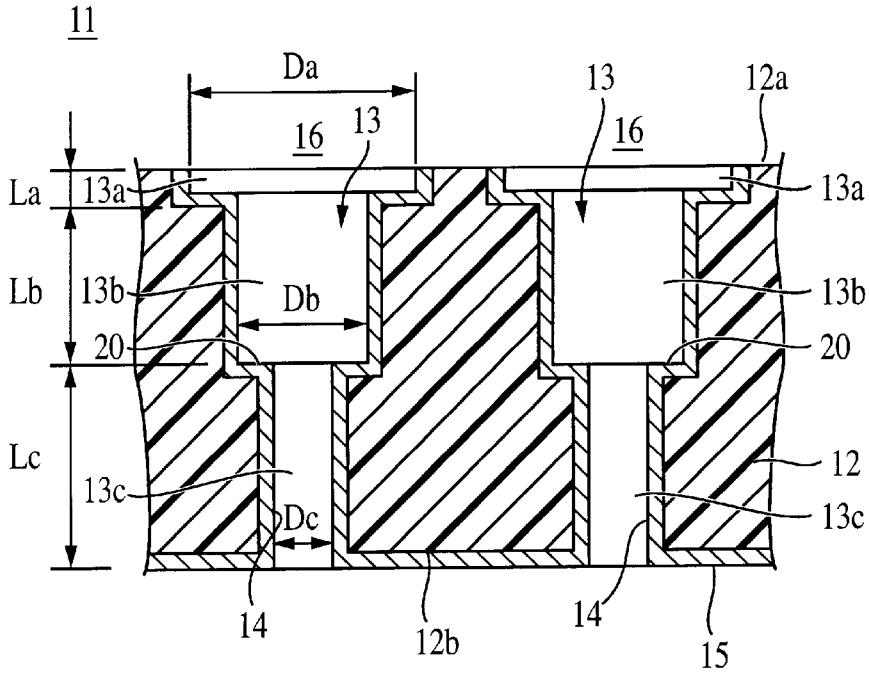
FIG. 2 is a fragmentary longitudinal sectional view of the dielectric filter of FIG. 1.

FIGS. 1 and 2 show a preferable embodiment of the present invention. This dielectric filter 11 has a rectangular box-shaped dielectric block 12 formed of a dielectric material. In the dielectric block 12, are formed a plurality (4 in this embodiment) of through-holes 13 being circular in the transverse plane, which cut through the block from the top surface 12*a* to the bottom surface 12*b* shown in FIG. 1. While on the internal surface of each of the through-holes 13, respective internal conductors 14 are formed, an external conductor 15 is formed on the external surface of the dielectric block 12 except for the top surface. That is, the external conductor 15 is electrically separated (disconnected) from the internal conductors 14 on the top surface 12*a* (referred to as a separated side below) of the dielectric block 12, while is short-circuited (connected) to the internal conductors 14 on the bottom surface 12*b* (referred to as a short-circuited side below). At the right and left ends of the dielectric block 12, an output-pattern electrode 19 and an input-pattern electrode 18 are respectively formed which are separated from the external conductor 15 across predetermined gaps, respectively.

The internal conductors 14, together with the external conductor 15 and the dielectric block 12, form the dielectric resonators 16 with ¼-wavelength using the separated side 12*a* and the short-circuit side 12*b* of the dielectric block 12 as an open surface and a short surface, respectively. The dielectric resonators 16 are electromagnetically coupled with each other to form a band-pass type filter. Each of the through-holes 13, as shown in FIG. 2, has a large-diameter hole portion 13*b* and a small-diameter hole portion 13*c*, which communicates with the large-diameter hole portion 13*b*, and a shoulder portion 20 is formed across the boundary of the two portions. The large-diameter hole portion 13*b* is disposed near the separated side 12*a* of the dielectric block 12, while the small-diameter hole portion 13*c* is disposed near the short-circuit side 12*b* of the dielectric block 12.

Each of the through-holes 13 further has a coupling adjustment hole portion 13*a* on the separated side 12*a* of the dielectric block 12 for the purpose of a fine adjustment of the electromagnetic coupling of the dielectric resonators 16 adjoining each other. The coupling adjustment hole portion 13*a*, having a different diameter from those of the large-diameter hole portion 13*b* and the small-diameter hole portion 13*c*, communicates with the large-diameter hole portion 13*b* and the small-diameter hole portion 13*c* as well. This coupling adjustment hole portion 13*a* can be formed, together with the large-diameter hole portion 13*b* and the small-diameter hole portion 13*c*, either when the dielectric block 12 is molded by a die, or by cutting the dielectric block 12 after the dielectric block 12 is formed.

In this configuration, as shown in FIG. 2, when the axial lengths of the coupling adjustment hole portion 13*a*, the large-diameter hole portion 13*b* and the small-diameter hole portion 13*c* are referred to as La, Lb, and Lc, respectively, the axial length of the through-hole 13 can be shortened to the most suitable length by adjusting the lengths Lb and Lc of the large-diameter hole portion 13*b* and the small-diameter hole portion 13*c*, respectively. When Lb=Lc, the axial length of the through-hole 13 is minimized to reduce the height of the dielectric block 12 to a minimum.

The coupling capacitance Ck of the dielectric resonators 16 adjoining each other can be roughly obtained to be electromagnetically coupled together by adjusting the diameters Db and Dc of the large-diameter hole portion 13*b* and the small-diameter hole portion 13*c*, respectively. When La≦(Lb+Lc), the coupling adjustment hole portion 13*a* can be equivalently regarded as a capacitance. Accordingly, since a micro-coupling-capacitance Ck' of the dielectric resonators 16 adjoining each other can be obtained by adjusting the axial length La and the diameter Da of the coupling adjustment hole portion 13*a*, a fine adjustment of the electromagnetic coupling of the dielectric resonators 16 adjoining each other is achieved to obtain the most suitable electromagnetic coupling.

Therefore, in the dielectric filter 11, the axial lengths Lb and Lc and the diameters Db and Dc of the large-diameter hole portion 13*b* and the small-diameter hole portion 13*c*, respectively, can be designed so that the electromagnetic coupling of the dielectric resonators 16 and 16 adjoining with each other is optimized, while a fine adjustment can be achieved by adjusting the axial length La and the diameter Da of the coupling adjustment hole portion 13*a*.

In this embodiment, when La=0.2 mm, Lb=4 mm, and Lc=4 mm, the diameters Da of the coupling adjustment hole portion 13*a*, Db of the large-diameter hole portion 13*b* and Dc of the small-diameter hole portion 13*c*, are set at 1.3 mm, 0.9 mm, and 0.6 mm, respectively.

Other embodiments of a dielectric filter according to the present invention are shown in FIGS. 3 to 6. In FIGS. 3 to 6, reference will be made in which like reference characters designate like portions in FIGS. 1 and 2 without description for brevity.

Figure 3:
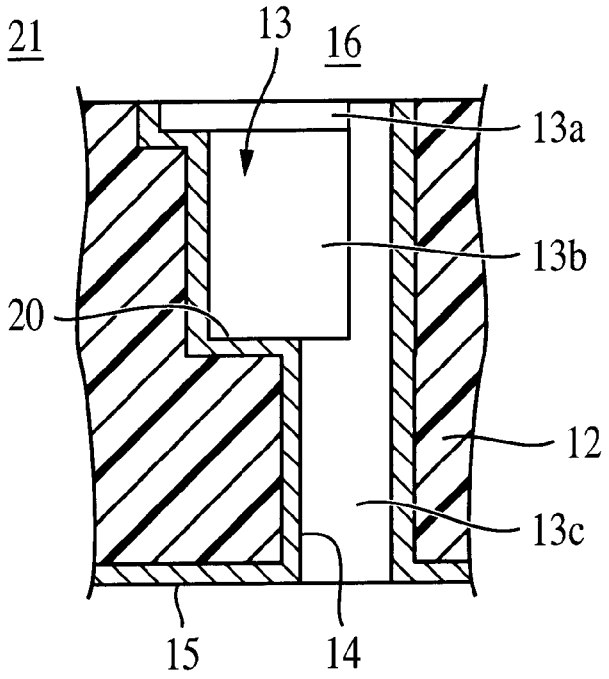
FIG. 3 is a fragmentary longitudinal sectional view of a dielectric filter according to another preferable embodiment of the present invention.
Figure 4:
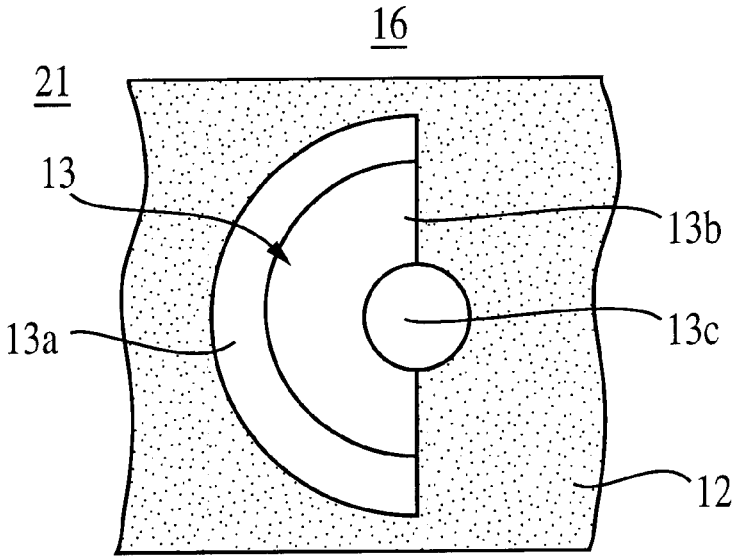
FIG. 4 is a fragmentary plan view of the dielectric filter shown in FIG. 3.

A dielectric filter 21 shown in FIGS. 3 and 4, is the same as the dielectric filter 11 described in accordance with FIGS. 1 and 2, except that the shape of the right sides of the large-diameter hole portion 13*b* and the coupling adjustment hole portion 13*a* of the through-hole 13 are equalized with that of the small-diameter hole portion 13*c*. In this configuration, by appropriately adjusting a sector angle of the left side of the large-diameter hole portion 13*b* and the coupling adjustment hole portion 13*a* of which the radius is different from the radius of the small-diameter hole portion 13*c*, the adjustments of degree of shortening of an axial length and degree of coupling of the dielectric resonators 16 can be achieved to further increase degree of freedom in the adjustments of degree of shortening of an axial length and degree of coupling of the dielectric resonators 16.

Figure 5:
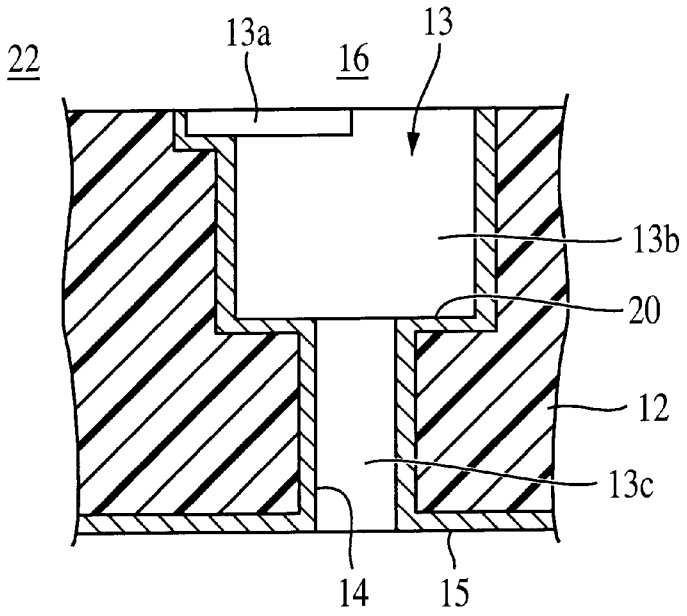
FIG. 5 is a fragmentary longitudinal sectional view of a dielectric filter according to still another preferable embodiment of the present invention.

A dielectric filter 22 shown in FIG. 5, is the same as the dielectric filter 11 described in accordance with FIGS. 1 and 2, except that the shape of the right side of the coupling adjustment hole portion 13*a* of the through-hole 13 is equalized with that of the large-diameter hole portion 13*b*. In this configuration, by appropriately adjusting a sector angle of the left side of the coupling adjustment hole portion 13*a* of which the radius is different from the radius of the large-diameter hole portion 13*b*, the adjustment of degree of coupling of the dielectric resonators 16 can be achieved to further increase degree of freedom in the adjustment of degree of coupling of the dielectric resonators 16.

Figure 6:
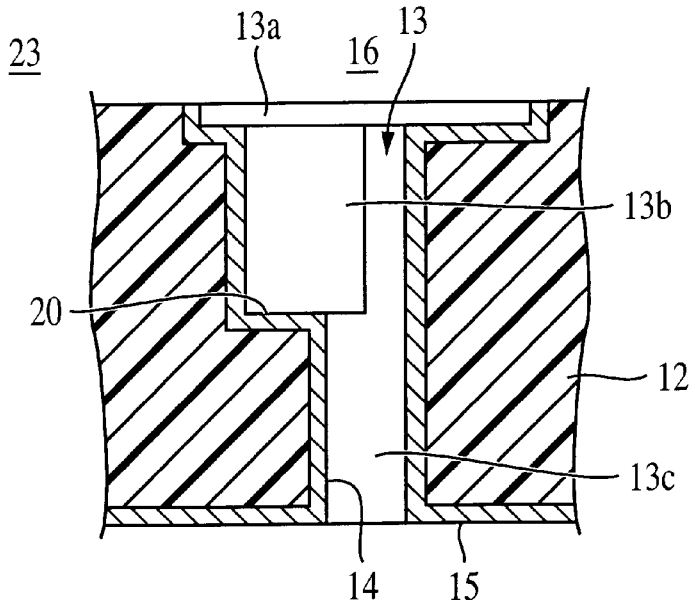
FIG. 6 is a fragmentary longitudinal sectional view of a dielectric filter according to still another preferable embodiment of the present invention.

A dielectric filter 23 shown in FIG. 6, is the same as the dielectric filter 11 described in accordance with FIGS. 1 and 2, except that the shape of the right side of the large-diameter hole portion 13*b* of the through-hole 13 is equalized with that of the small-diameter hole portion 13*c*. In this configuration, by appropriately adjusting a sector angle of the left side of the large-diameter hole portion 13*b* of which the radius is different from the radius of the small-diameter hole portion 13*c*, the adjustment of degree of shortening of an axial length of the dielectric resonator 16 can be achieved to increase degree of freedom in the adjustment of degree of shortening of an axial length of the dielectric resonator 16.

Figure 7:
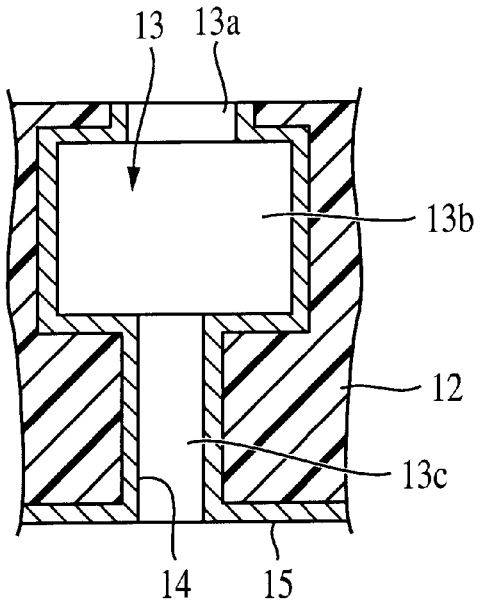
FIG. 7 is a fragmentary longitudinal sectional view of a dielectric filter according to still another preferable embodiment of the present invention.
Figure 8:
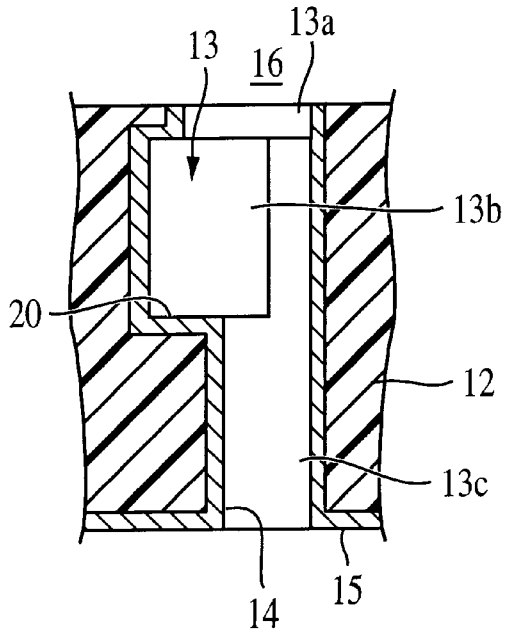
FIG. 8 is a fragmentary longitudinal sectional view of a dielectric filter according to still another preferable embodiment of the present invention.
Figure 9:
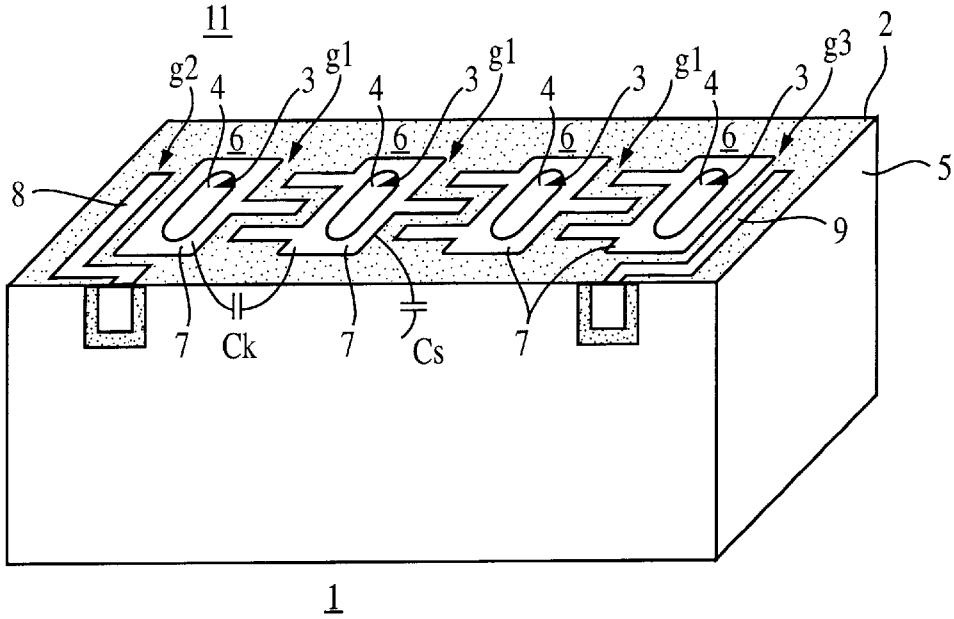
FIG. 9 PRIOR ART
FIG. 9 is an external perspective view of a conventional dielectric filter.
Figure 10:
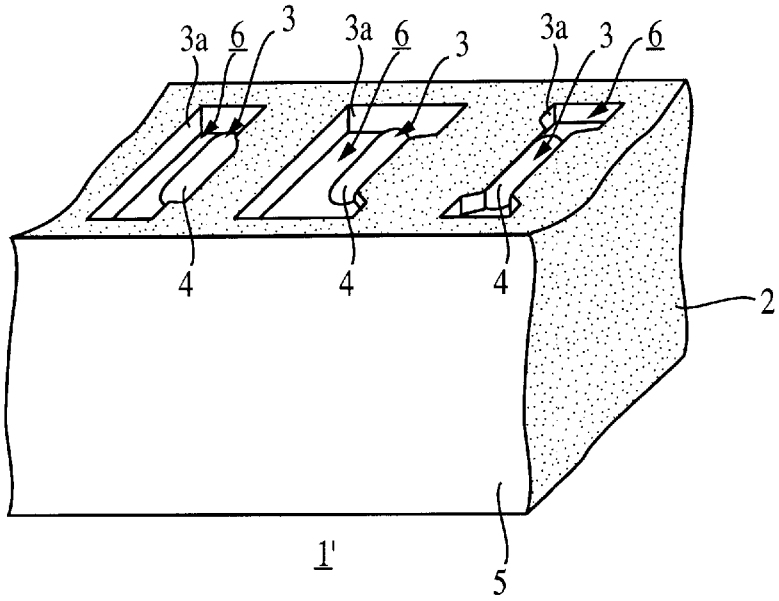
FIG. 10 PRIOR ART
FIG. 10 is an external fragmentary perspective view of another conventional dielectric filter.
Figure 11:
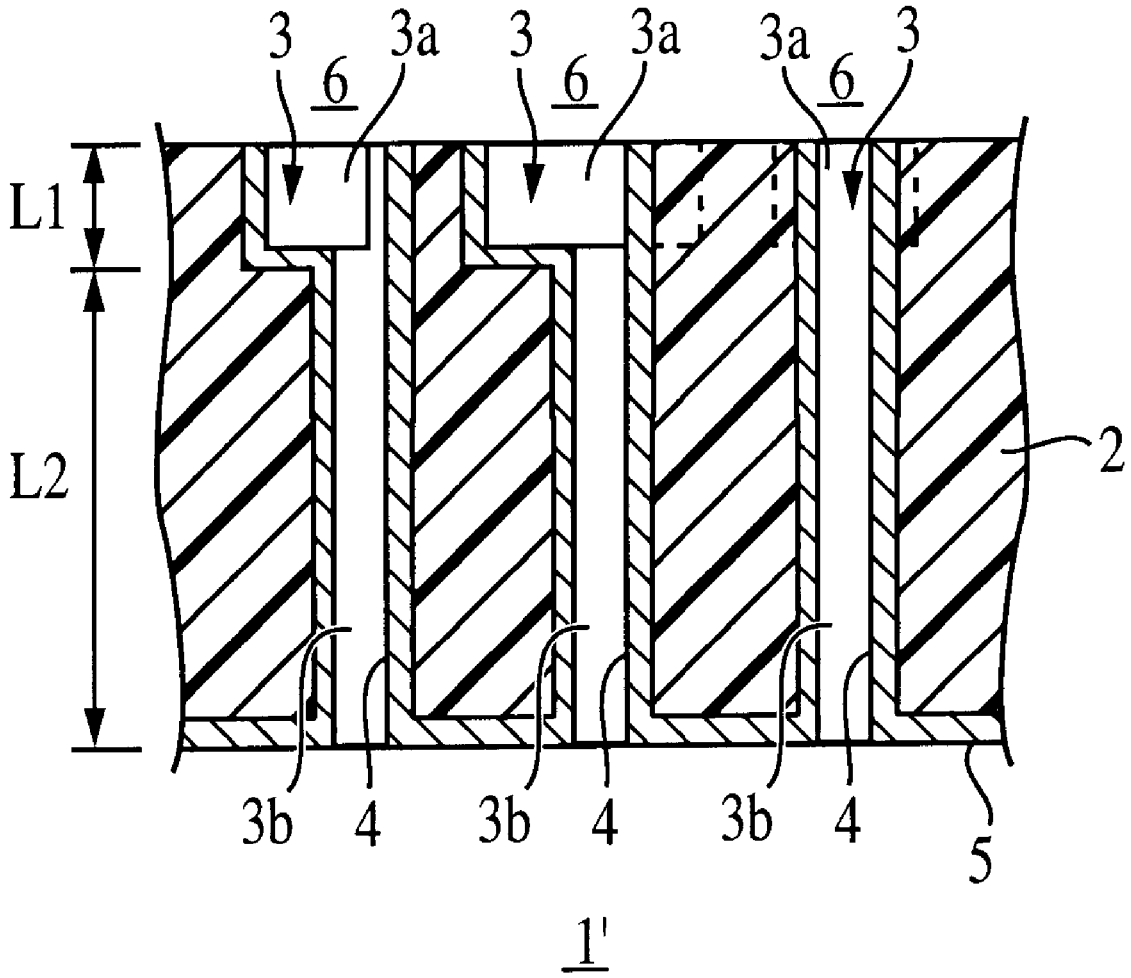
FIG. 11 PRIOR ART
FIG. 11 is a fragmentary longitudinal sectional view of the dielectric filter of FIG. 10.

The basic embodiments of the present invention are as described above; however, a dielectric filter according to the present invention is not limited to the embodiments. Various modifications may be made without departing from the scope of the present invention. For example, as shown in FIGS. 7 and 8, the diameter of the coupling adjustment hole portion 13*a* of the through-hole 13 may be smaller than the diameter or the radius of the large-diameter hole portion 13*b*. Further, the shape in transverse plane of the through-hole 13 is not limited to a circle and may be rectangular. The number of the through-holes 13 in the dielectric block 12 may be five or more.

In addition to a band-pass type filter, the dielectric filter may be a duplexer, which is disposed between an antenna of radio communication equipment such as a mobile-phone and a transmitting system and a receiving system. The duplexer supplies a transmitting signal having a predetermined transmitting frequency from the transmitting system to the antenna, while it supplies a receiving signal having a predetermined frequency from a signal received by the antenna to the receiving system.

The present invention is disclosed and described according to particularly preferable embodiments, however, it is to be understood that the above-mentioned and other modifications may be made by those skilled in the art without departing from the spirit and scope of the present invention.

What is claimed is:

1. A dielectric filter, comprising:

a dielectric block having a first surface and a second surface being opposite to said first surface;

a plurality of dielectric resonators having through-holes which pass through from said first surface to said second surface and internal conductors which cover the internal surfaces of said through-holes; and an external conductor which covers the external surface of said dielectric block except for said first surface, wherein at least one of said through-holes has a large-diameter hole portion, a small-diameter hole portion which communicates with said large-diameter hole portion, and a shoulder portion which forms a transition between said large- and small-diameter hole portions; and wherein said at least one of said through-holes further comprises a coupling adjustment hole portion which communicates with said large- and small-diameter hole portions and can be adjusted in size for making a fine adjustment of electromagnetic coupling between adjacent said dielectric resonators, disposed at the side adjacent to said first surface of said dielectric block, and having a different diameter from those of said large-diameter hole portion and said small-diameter hole portion.

2. A dielectric filter according to claim 1, wherein said coupling adjustment hole portion is larger in diameter than said large-diameter hole portion.

3. A dielectric filter according to claim 1, wherein said coupling adjustment hole portion is smaller in diameter than said large-diameter hole portion.

4. A dielectric filter according to claim 1, wherein said coupling adjustment hole portion is smaller in length than said large-diameter hole portion and said small-diameter hole portion.

5. A dielectric filter according to claim 1, wherein said transition between said large- and small-diameter hole portions is a step.

6. The dielectric filter of claim 1, wherein the large-diameter hole portion and the coupling adjustment hole portion have right side shapes which are the same as a corresponding right-side shape of the small-diameter hole portion.

7. The dielectric filter of claim 1, wherein the coupling adjustment hole portion has a right side shape which is the same as a corresponding right-side shape of the large-diameter hole portion.

8. The dielectric filter of claim 1, wherein the large-diameter hole portion has a right side shape which is the same as a corresponding right-side shape of the small-diameter hole portion.

9. The dielectric filter of claim 1, wherein the coupling adjustment hole portion has a transverse dimension which is smaller than a corresponding transverse dimension of the large-diameter hole portion.

10. The dielectric filter of claim 1, wherein a transverse cross-sectional shape of the through hole is circular.

11. A method of adjusting characteristics of a dielectric filter, the dielectric filter comprising:

a dielectric block having a first surface and a second surface being opposite to said first surface;

a plurality of dielectric resonators having through-holes which pass through from said first surface to said second surface and internal conductors which cover the internal surfaces of said through-holes; and an external conductor which covers the external surface of said dielectric block except for said fist surface, wherein at least one of said through-holes has a large-diameter hole portion, a small-diameter hole portion which communicates with said large-diameter hole portion, and a shoulder portion which forms a transition between said large- and small-diameter hole portions; and wherein said at least one of said through-holes further comprises a coupling adjustment hole portion which communicates with said large- and small-diameter hole portions and can be adjusted in size for making a fine adjustment of electromagnetic coupling between adjacent said dielectric resonators, disposed at the side adjacent to said first surface of said dielectric block, and having a different diameter from those of said large-diameter hole portion and said small-diameter hole portion;

said method comprising the step of roughly adjusting the electromagnetic coupling of dielectric resonators adjoining each other by adjusting the diameters of the large-diameter hole portion and the small-diameter hole portion.

12. The method of claim 11, further comprising the step of finely adjusting the electromagnetic coupling of the dielectric resonators adjoining each other by adjusting the axial length and the diameter of the coupling adjustment hole portion.

13. The method of claim 11, further comprising the step of roughly setting the coupling capacitance Ck of dielectric resonators adjoining each other to electromagnetically couple said resonators by adjusting the diameters Db and Dc of the large-diameter hole portion and the small-diameter portion (13*c*), respectively.

14. The method of claim 11, wherein the axial lengths of the coupling adjustment hole portion, the large-diameter hole portion, and the small-diameter hole portion are referred to as La, Lb, and Lc, respectively, and further comprising the step of adjusting the axial length of the through-hole by adjusting the lengths Lb and Lc of the large-diameter hole portion and the small-diameter hole portion, respectively.

15. The method of claim 14, further comprising the step of minimizing the axial length of the through-hole and thereby the height of the dielectric block by setting Lb=Lc.

16. The method of claim 14, further comprising the step of setting $La \leqq (Lb+Lc)$.

17. The method of claim 16, further comprising the step of setting a micro-coupling-capacitance Ck' of the dielectric resonators adjoining each other by adjusting the axial length La and the diameter Da of the coupling adjustment hole portion, thereby finely adjusting the electromagnetic coupling of the dielectric resonators adjoining each other.

* * * * *